US007393256B2

(12) United States Patent
Clutton et al.

(10) Patent No.: US 7,393,256 B2
(45) Date of Patent: Jul. 1, 2008

(54) FIN ASSEMBLY

(75) Inventors: Troy Clutton, Harbord (AU); Dean Cole, Harbord (AU)

(73) Assignee: C & C Fin Designs Pty Ltd, Harbord (AU)

( * ) Notice: Subject to any disclaimer, the term of this patent is extended or adjusted under 35 U.S.C. 154(b) by 0 days.

(21) Appl. No.: 10/501,582

(22) PCT Filed: Jan. 14, 2003

(86) PCT No.: PCT/AU03/00023

§ 371 (c)(1),
(2), (4) Date: Jul. 14, 2004

(87) PCT Pub. No.: WO03/057559

PCT Pub. Date: Jul. 17, 2003

(65) Prior Publication Data

US 2005/0124238 A1 Jun. 9, 2005

(30) Foreign Application Priority Data

Jan. 14, 2002 (AU) ..... PR9949
Apr. 16, 2002 (AU) ..... PR1717

(51) Int. Cl.
*B63B 1/00* (2006.01)
*B63B 35/79* (2006.01)
*B63B 3/38* (2006.01)

(52) U.S. Cl. ..... 441/79; 441/74; 114/140

(58) Field of Classification Search ..... 441/74, 441/79; 114/39.12, 39.15, 126–140, 143, 114/152

See application file for complete search history.

(56) References Cited

U.S. PATENT DOCUMENTS

| | | | | |
|---|---|---|---|---|
| 4,733,496 | A | 3/1988 | Wallner | |
| 4,831,954 | A * | 5/1989 | Kinouchi et al. | 114/163 |
| 4,850,917 | A * | 7/1989 | Wilson et al. | 441/79 |
| 5,022,337 | A * | 6/1991 | Caldwell | 441/79 |
| 5,328,397 | A | 7/1994 | Whitty | |
| 5,464,359 | A | 11/1995 | Whitty | |
| 5,672,081 | A | 9/1997 | Whitty | |

FOREIGN PATENT DOCUMENTS

| | | | |
|---|---|---|---|
| AU | 84471/82 | A | 1/1983 |
| AU | 8447182 | A * | 8/1984 |

(Continued)

OTHER PUBLICATIONS

Abstract of AU 9170912 A, published Aug. 1991.*

(Continued)

*Primary Examiner*—Ajay Vasudeva
(74) *Attorney, Agent, or Firm*—Henricks, Slavin & Holmes

(57) ABSTRACT

An integrally formed fibreglass fin assembly (1) including a base (2)—that is defined by broken lines (3,4)—for mounting the assembly to an object in the form of a surfboard (5). A primary fin (6) extends upwardly from base (2)—in that it extends upwardly from line (3)—and has a compound arcuate leading primary edge (7) and a compound arcuate trailing primary edge (8). A secondary fin (9) extends rearwardly and upwardly from base (2)—in that it extends from line (4)—and has a compound arcuate leading secondary edge (10) and a compound arcuate trailing secondary edge (11).

65 Claims, 5 Drawing Sheets

FOREIGN PATENT DOCUMENTS

| | | | | |
|---|---|---|---|---|
| AU | 68811/87 | A | | 8/1987 |
| AU | 199170912 | A1 | | 2/1990 |
| AU | 9170912 | A | * | 8/1991 |
| DE | 3248580 | A1 | | 7/1984 |
| FR | 2516472 | A | | 5/1983 |
| WO | WO85/03237 | | | 8/1985 |

OTHER PUBLICATIONS

Table 1 (Partial from specification), Table 2 (Partial from specification), dimensions of prior art fin assemblies.

* cited by examiner

FIGURE 1
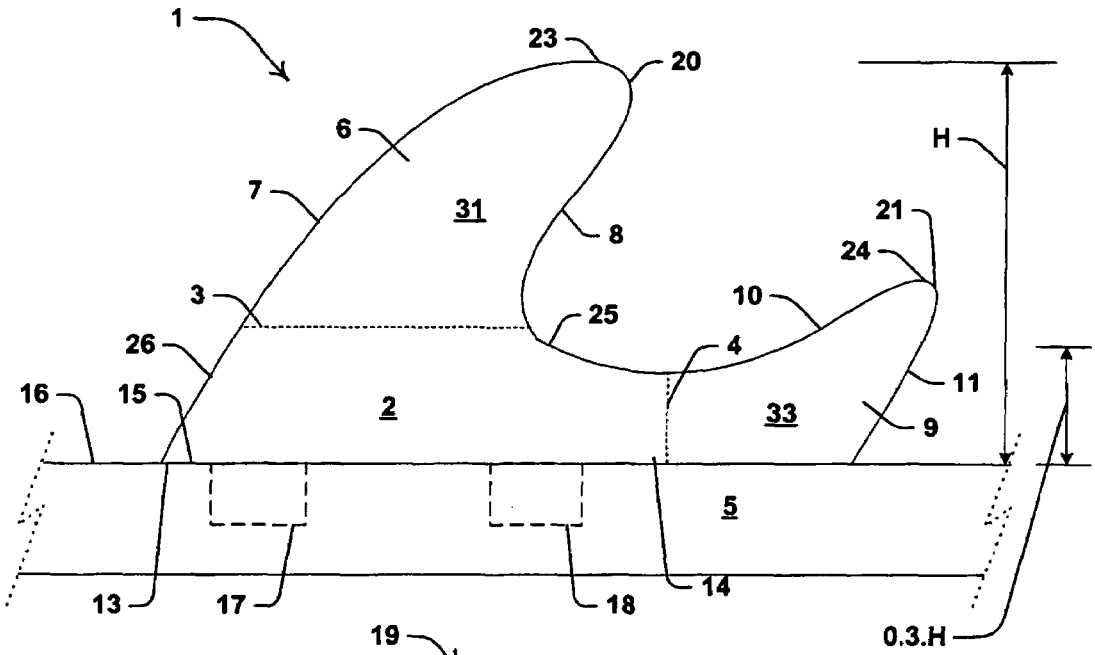
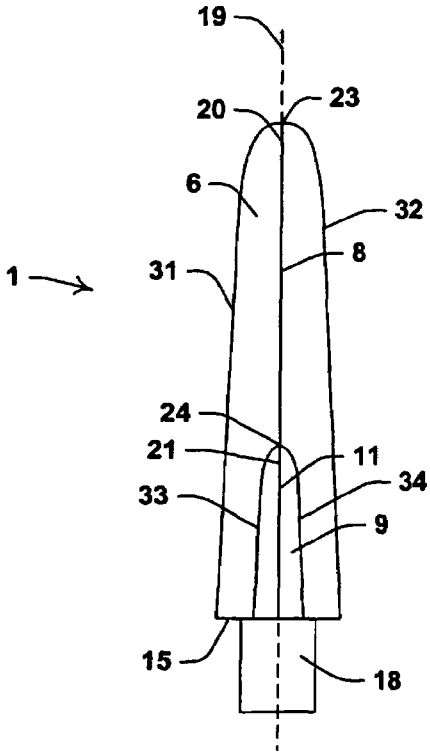
FIGURE 2

FIGURE 5
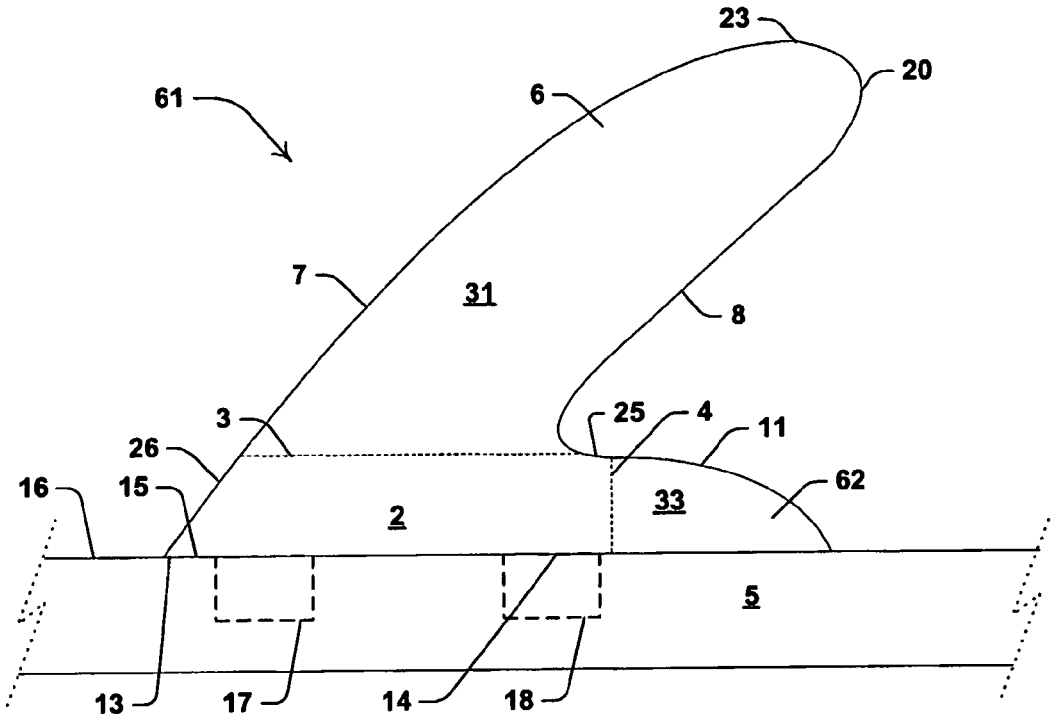
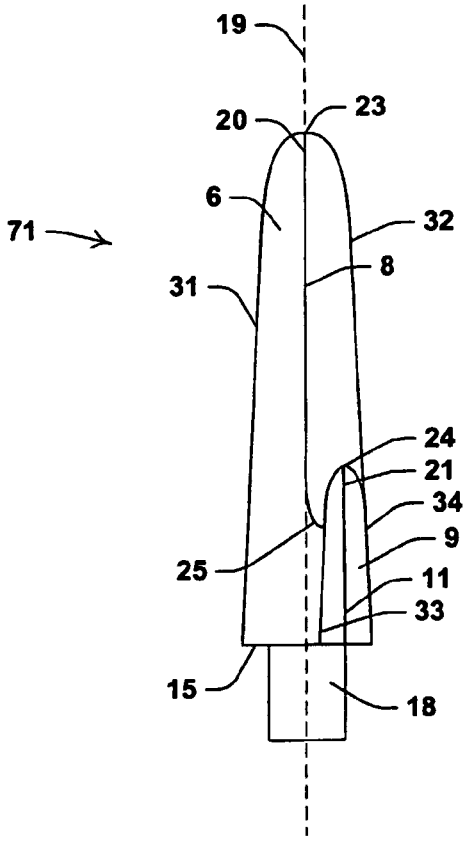
FIGURE 6

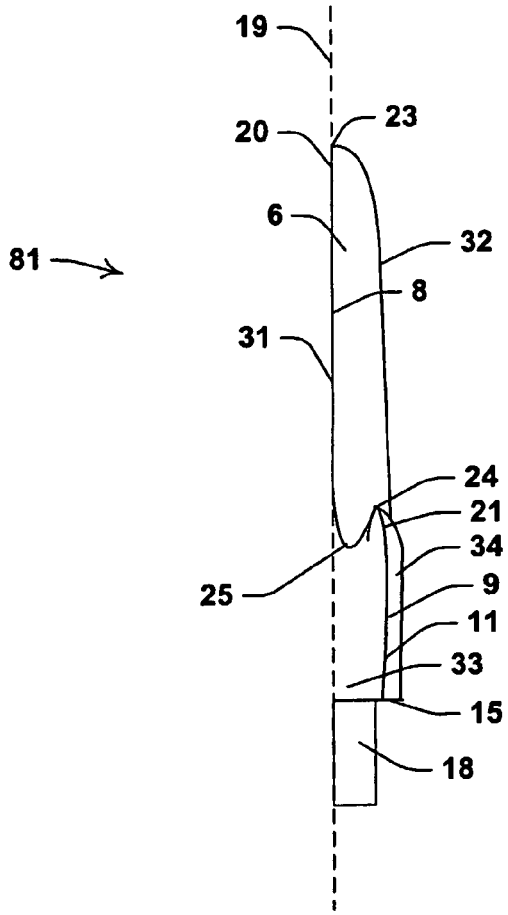
FIGURE 7
FIGURE 8
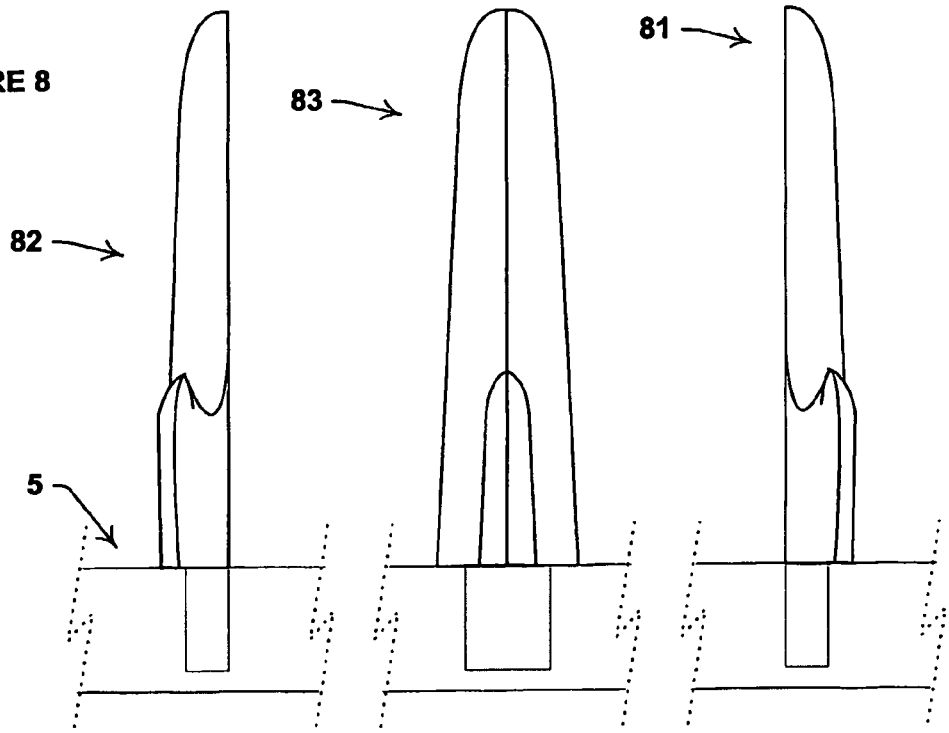

FIN ASSEMBLY

CROSS REFERENCE TO RELATED APPLICATIONS

This application is a National Stage of International Application No. PCT/AU03/00023, filed Jan. 14, 2003.

BACKGROUND TO THE INVENTION

The present invention relates to a fin and in particular to a fin assembly.

The invention has been developed primarily for use with surf craft such as surfboards and will be described hereinafter with reference to that application. However, the invention is not limited to that particular field of use and is also applicable to other surf craft including surf skis and bogie boards and to water craft including kayaks, canoes, boats, sailboards and the like.

DISCUSSION OF THE PRIOR ART

Known fins or fin assemblies for surfboards have only incrementally advanced in the last forty years notwithstanding the reduction in size of boards and the use of modern manufacturing materials and techniques. An early style fin has been used with a board known as the Malabo board, while more recent boards typically make use of a fin known as the Simon Andersen fin. The latter was introduced in the 1980's and was developed into a triple fin arrangement that is mounted at the rear of the board. The centre one of the three fins included symmetric faces and is mounted along the centre line of the board. The other two fins include asymmetric faces and are mounted at an acute angle to the centre line and which are adjacent to but forward of the centre fin. This arrangement was reputed to provide the "Three Fin Thrust".

While the triple fin arrangement has significant advantages over the Malabo fin, it also has substantial limitations, such as increased drag and reduced manoeuvrability.

Another innovation was an adaptation of the so-called Ben Lexcen fin—as disclosed in PCT application number PCT/AU85/00012—to surf craft. This fin design was the most radical deviation from the standard fin design known to date. However, as presently understood, it has enjoyed neither significant commercial success nor acceptance within the surfing community.

Fins are now modular and generally bought separately to a surfboard or other surf craft, as illustrated by the disclosure in the following U.S. Pat. Nos. 5,328,397, 5,464,359 and 5,672,081. While this allows fin design to occur separately from that of the board, replacement fins are typically similar to those originally fitted. It is understood that this is a result of replacement fins needing to be received within the same retaining formations as the original fins, and also due to the limitations imposed by the highly image conscious nature of the users of the surfboards.

Any discussion of the prior art throughout the specification should in no way be considered as an admission that such prior art is widely known or forms part of common general knowledge in the field.

SUMMARY OF THE INVENTION

It is an object of the present invention to ameliorate one or more of the deficiencies of the prior art or at least to provide a useful alternative.

According to a first aspect of the invention there is provided a fin assembly for a surf craft, the assembly including:

a base for mounting the assembly to the surf craft;

a primary fin extending from the base and having a leading primary edge and a trailing primary edge; and a secondary fin extending from the base and having a leading secondary edge and a trailing secondary edge.

Preferably, the base and the fins are integrally formed.

Preferably also, the leading edges of the fins are aligned. More preferably, the leading and the trailing edges are aligned. Even more preferably, the base extends longitudinally between the leading primary edge and the trailing secondary edge.

In a preferred form, the trailing primary edge and the leading secondary edge are joined by an intermediate arcuate edge defined by the base. More preferably, the arcuate edge is of varying radius.

Preferably, the primary fin extends along a first plane that is normal to the base.

More preferably, both the primary and secondary fins extend along the first plane. Preferably also, the fins include respective pairs of opposite faces that extend between the leading and trailing edges. More preferably, one or more of the faces are substantially planar. In other embodiments, however, one or more of the faces are substantially arcuate.

In a preferred form, the fins are longitudinally spaced apart. In some embodiments, the fins are transversely spaced apart.

According to a second aspect of the invention there is provided a fin assembly including:

a base for mounting the assembly to an object;

a primary fin extending from the base and having a leading primary edge and a trailing primary edge; and a secondary fin extending rearwardly from the base and having a leading secondary edge and a trailing secondary edge.

Preferably the leading primary edge is curved substantially complementarily to the leading secondary edge.

According to a third aspect of the invention there is provided a fin assembly including:

a base for mounting the assembly to an object;

a larger fin extending from the base and having a leading primary edge and a trailing primary edge and a high rake; and a smaller fin extending rearwardly from the base and having a leading secondary edge and a trailing secondary edge.

Preferably, the edges extend along a single plane. More preferably, smaller fin is, in use, deformable in a direction normal to the plane.

According to a fourth aspect of the invention there is provided a fin assembly for a surf craft, the assembly including:

a base for mounting the assembly to the surf craft;

a fin that extends from the base and which has a leading edge and a trailing edge that meet at a tip, where the edges lie substantially within a common plane; and a lobe extending rearwardly from the base, the lobe having a lobe edge that has a tangent that is parallel to the plane.

According to a fifth aspect of the invention there is provided a fin assembly for a surf craft, the assembly including:

a base having a substantially planar surface for mounting the assembly to the surf craft;

a fin that extends from the base and which has a leading edge and a trailing edge that meet at a tip; and a lobe extending rearwardly from the base, the lobe having a lobe edge that has a tangent that is parallel to the surface.

Preferably, the base, the fin and the lobe are integrally formed. More preferably, the base and the lobe extend longitudinally. Even more preferably, the base extends longitudinally between the leading edge and the trailing edge.

Preferably also, the lobe is directly underlying the leading and the trailing edge. More preferably, the lobe, the trailing edge and the leading edge extend in a common plane. Preferably also, the trailing edge is feathered in an area intermediate of the lobe and the leading edge.

In a preferred form, the trailing edge and the lobe are joined by an intermediate arcuate edge defined by the base. More preferably, the arcuate edge is of varying radius.

Preferably, the fin extends along a first plane that is normal to the base.

Preferably also, the fin includes a pair of opposite faces that extend between the leading and the trailing edge. More preferably, one or both of the faces are substantially planar. In other embodiments, however, one or both of the faces are substantially arcuate.

Preferably, the edges extend along a common plane.

In a preferred form, the lobe includes a leading secondary edge and a trailing secondary edge. More preferably, the lobe is a secondary fin.

Preferably also, the fin assembly includes one or more mounting formations that extend from the surface for engaging with complementary locating formations extending from the surf craft. More preferably, the or each mounting formation is a protrusion, and the or each locating formation is a recess. Even more preferably the assembly includes two spaced apart mounting formations and the surf craft includes at least two locating formations.

According to a sixth aspect of the invention there is provided a fin assembly including:

a base for mounting the assembly to an object;

a primary fin extending from the base;

a secondary fin extending from the base, wherein the base, the primary fin and the secondary fin include a combined total sectional area ($A_f$); and a feathered portion between two or more of the primary fin, the secondary fin and the base, wherein the feathered portion includes a sectional area ($A_p$) where $A_p>0.2.A_f$.

Preferably, $A_p>0.24.A_f$. More preferably, $A_p>0.35.A_f$.

According to a seventh aspect of the invention there is provided a surf craft including a fin assembly of one of the first, second, fourth or fifth aspects of the invention.

According to an eighth aspect of the invention there is provided a surf craft including a fin assembly of one of the third, fourth or sixth aspects of the invention, where the object is the surf craft.

According to a ninth aspect of the invention there is provided a method of manufacturing a fin assembly for a surf craft, the method including:

forming a base for mounting the assembly to the surf craft;

forming a primary fin that extends from the base and which has a leading primary edge and a trailing primary edge; and forming a secondary fin that extends from the base and which has a leading secondary edge and a trailing secondary edge.

Preferably, the forming steps are performed simultaneously. More preferably, the base, the primary fin and the secondary fin are integrally formed.

Preferably also, the method includes forming at least one mounting formation that extends from the base for engaging with a complementary locating formation that extends from the surf craft.

According to a tenth aspect of the invention there is provided a fin assembly for a surf craft, the assembly, in use, providing a predetermined sectional water engaging area (A) and including:

a base for mounting the assembly to extend from a surface of the surf craft;

a primary fin extending from the base and away from the surface; and a secondary fin extending from the base, wherein a high proportion of A is near the surface.

Preferably, the primary fin terminates in a point having a predetermined height (H) with respect to the surface, and at least 0.4.A is within 0.3.H of the surface. More preferably, at least 0.45.A is within 0.3.H of the surface. Even more preferably, at least 0.5.A is within 0.3.H of the surface.

In other embodiments, at least 0.35.A is within 0.22H of the surface.

According to an eleventh aspect of the invention there is provided a fin assembly for a surf craft, the assembly including a sectional area of less than 95 $cm^2$.

Preferably, the sectional area is between about 90 $cm^2$ and 95 $cm^2$. More preferably, the assembly extends from the surf craft and the perimeter of the area, excluding any common perimeter with the surf craft, is greater than about 380 mm. More preferably, it is greater than about 400 mm.

According to a twelfth aspect of the invention there is provided a fin assembly for extending from a surface of a surf craft, the assembly extending longitudinally and having a longitudinal peripheral edge that terminates at two longitudinally spaced ends that are both disposed adjacent to the surface, the edge being at least 380 mm.

Preferably, the edge is at least 400 mm. More preferably, the assembly includes a predetermined water engaging sectional area A that is bounded by the edge, where A is less than about 95 $cm^2$.

According to a thirteenth aspect of the invention there is provided a fin assembly for extending from a surface of a surf craft, the assembly extending longitudinally and having a longitudinal peripheral edge (PE) that terminates at two longitudinally spaced ends that are both disposed adjacent to the surface, the edge bounding a sectional area (A) of the assembly, wherein A/PE is less than 25.

Preferably, A/PE is less than 24. More preferably, A/PE is less than 23.

BRIEF DESCRIPTION OF THE DRAWINGS

Preferred embodiments of the invention will now be described, by way of example only, with reference to the accompanying drawings in which:

FIG. 1 is a side view of a fin assembly according to a first embodiment of the invention that is mounted to a surfboard;

FIG. 2 is a rear view of the fin of FIG. 1 when not mounted to the surfboard;

FIG. 5 is a side view of a fin assembly according to a fourth embodiment of the invention;

FIG. 6 is a rear view of a fin assembly according to another aspect of the invention;

FIG. 7 is a rear view of an alternative embodiment of the invention; and

FIG. 8 is a rear elevation view of an alternative example of the inventions.

DESCRIPTION OF THE PREFERRED EMBODIMENTS

Figure 3:
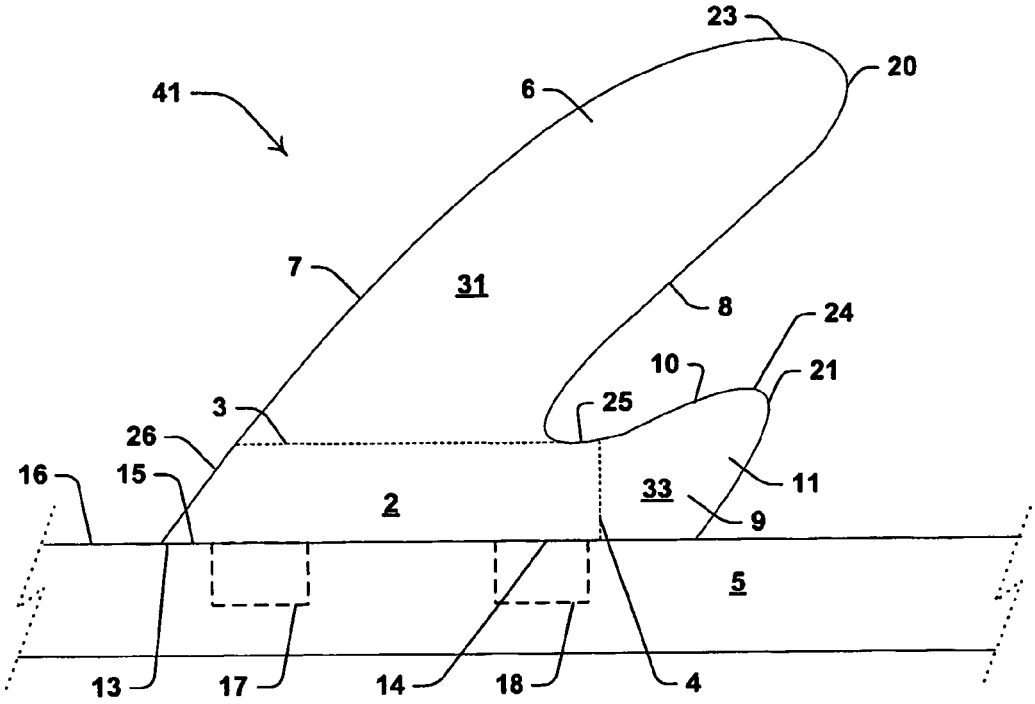
FIG. 3 is a side view of a fin assembly according to a second embodiment of the invention.

Referring to FIG. 1, there is illustrated an integrally formed fibreglass fin assembly 1 including a base 2—that is defined by broken lines 3 and 4—for mounting the assembly to an object in the form of a surfboard 5. A primary fin 6 extends upwardly from base 2—in that it extends upwardly from line 3—and has a compound arcuate leading primary edge 7 and a compound arcuate trailing primary edge 8. A secondary fin 9 extends rearwardly and upwardly from base 2—in that it extends from line 4—and has a compound arcuate leading secondary edge 10 and a compound arcuate trailing secondary edge 11.

In this embodiment, the arcuate form of the leading primary edge 7 and leading secondary edge 10 are substantially the same, although scaled for the different heights of fins 6 and 9. It will be appreciated that for surf craft, the height of the fin is referred to as its depth.

It will be appreciated that the assembly, as represented in FIG. 1, and the assemblies as represented in the other Figures, are illustrative only of the preferred embodiments and all the proportions may not be absolutely true to scale. When interpreting the drawings, use should be made of the accompanying description.

Base 2 includes a bottom surface 15 that is substantially planar and which is abutted with an adjacent and opposed substantially planar surface 16 of board 5. Surface 15 extends longitudinally along board 5 from a leading end 13 to a trailing end 14. Two longitudinally spaced apart mounting formations, in the form of prismatic protrusions 17 and 18, extend downwardly from the bottom surface and into complementary locating formations, in the form of prismatic recesses (not shown). Protrusion 17, protrusion 18, fin 6 and fin 9 are all integrally formed with base 2.

In other embodiments alternative means of connection between assembly 1 and board 5 are used. For example, in some embodiments, assembly 1 and board 5 are integrally formed, while in other embodiments, use is made of adhesive or other bonding materials to affect a fixed mounting of the components. Alternatively, assembly 1 is able to be removeably mounted to board 5 by means such as disclosed in U.S. Pat. No. 5,328,397.

While assembly 1 is illustrated in an inverted configuration, this is for illustration purposes only. In use, assembly 1 extends downwardly from board 5 for protruding into the water in which board 5 is disposed.

All of edges 7, 8, 10 and 11 are aligned, in that they lie within a common longitudinally extending plane 19. In this embodiment, and as best shown in FIG. 2, plane 19 is normal to surface 16 of board 5.

Edges 7 and 8 intersect to define a primary fin tip 20, while edges 10 and 11 intersect to define a secondary fin tip 21. Tip 20 is an inflection point of edges 7 and 8, while tip 21 is an inflection point of edges 10 and 11.

As shown in FIG. 1, fin 6 includes an uppermost point 23, while fin 9 includes an uppermost point 24. It will be appreciated that, in use, points 23 and 24 will typically define the lowermost points of the respective fins.

The height of point 23 from base 2—that is, the depth of fin 6—is greater than that of tip 20, while the height of point 24 from base 2—that is, the depth of fin 9—is greater than that of tip 21. This results in edge 7 over wrapping the adjacent portion of edge 8. This is referred to as a feathering of edge 8.

Edge 8 and edge 10 are joined by an intermediate arcuate edge 25 that is defined by base 2. Edge 25 is of varying radius such that edges 8, 10 and 25 are continuous and co-planar. Moreover, base 2 includes a leading edge 26 that is continuous with edge 7.

Edges 26, 7, 8, 25, 10 and 11 are continuous and have a collective total length of about 430 mm. This is substantially longer than prior art assemblies of the same height as assembly 1.

Tips 20 and 21, and points 23 and 24 also lie in plane 19.

In this embodiment, the fins are longitudinally spaced apart. However, in other embodiments, the fins are transversely and/or longitudinally spaced apart.

Fin 6 includes a pair of opposite faces 31 and 32 that extend between the leading and trailing edge and line 3. Similarly, fin 9 includes a pair of opposite faces 33 and 34 that extend between edges 10 and 11 and line 4. Base 2 includes opposed surfaces that extend continuously from the other adjacent surfaces.

In this embodiment, all of faces 31, 32, 33 and 34 are non-planar. However, in other embodiments, faces 31 and 33 are substantially planar, or faces 32 and 34 are substantially planar. That is, corresponding sides of a fin assembly are planar or non-planar, as the case may be. In other embodiments, any one or more of the faces 31, 32, 33 and 34 are planar. In all cases, the faces of base 2 are shaped to provide a smooth and continuous transition between the fins.

Preferably, any non-planar faces are substantially arcuate.

The transverse thickness of assembly 1 varies to provide for low drag. Additionally, assembly 1 is of a reduced transverse thickness at or adjacent to line 4, that being the connection or boundary between base 2 and fin 9. This reduced thickness allows for a preferential transverse deformation of fin 9 about an axis that lies substantially along line 4. This typically slight accommodation of flex provides for an increased drive through and out of turns. That is, when a turn is commenced and underway, the transverse forces exerted upon assembly 1 flex fin 9 inwardly toward the centre of the arc, while fin 6 remains substantially unmoved from the centre line—in that it remains approximately tangential to the arc. However, as the board begins to straighten when coming out of a turn, the deformed portion quickly returns resiliently to the unbiased position and thereby contributes to the so-called "drive" out of the turn.

In other embodiments, the flexing is accommodated by other forms of structural weakness. For example, through the use of a less rigid material in the region of line 4, or the inclusion of apertures or recesses in base 2 and fin 9 adjacent to or overlying line 4.

The distance between point 23 and the bottom of base 2 is the depth of assembly 1 with respect to surface 16. This depth is indicated in FIG. 1 as H and is, in this embodiment, about 115 mm.

The effective sectional area of assembly 1 that is available to engage the water and resist transverse movement of board 5 is best shown in the side view of FIG. 1. This sectional area is referred to, in this specification, as the predetermined sectional water engaging area A and includes the sectional area of base 2, fin 6 and fin 9. As formations 17 and 18 are contained within board 5 they do not contribute to A. For this embodiment, A is about 97 $cm^2$. In the event that assembly 1 is mounted at an angle to the longitudinal axis of board 5, the effective area will be reduced. However, this is typical for fin assemblies.

One of the features of assembly 1 is that, in use, a high proportion of A is near surface 16. This is quantified by calculating the proportion of A that is within a given proportion of H from surface 16. In this embodiment, about 51.4 $cm^2$ lies within 0.3.H from surface 16. That is, about 53% of the total effective water engaging area of assembly 1—0.53.A—is provided by the bottom 30% of the assembly illustrated in FIG. 1. Again, it will be appreciated that, in use, assembly 1 will be inverted from the FIG. 1 configuration and, as such, it will be the top 30% of the assembly that provides the high proportion of the effective water engaging surface area.

Another feature of assembly 1 is that, adjacent to surface 16, it is long in comparison to prior art fins relative to its height. By way of example, assembly 1 has a longitudinal length of about 170 mm, and a depth of about 100 mm. Some more common prior art fin assemblies have a corresponding length dimension of less than about 130 mm. Notwithstanding, the preferred embodiments have similar sectional areas to the prior art fin assemblies. For example, a prior art fin assembly sold by Fin Control Systems Pty Ltd under the designation K2.1, includes a depth of about 115 mm, a sectional area of about 99 $cm^2$, a length adjacent to surface 16 of about 110 mm, and a water engaging peripheral edge of about 340 mm. Another prior art fin assembly, the Simon Andersen fin, includes a sectional area of about 101.5 $cm^2$, a longitudinal length adjacent to surface 16 of about 130 mm, and a water engaging peripheral edge of about 350 mm.

A further feature of assembly 1 is that it has a relatively long water engaging peripheral edge that is defined collectively by edges 26, 7, 8, 25, 10 and 11. These edges are continuous and have a collective length of about 430 mm. The prior art fins mentioned above have a far smaller corresponding dimension.

The water engaging peripheral edge referred to above is the perimeter of assembly 1 when viewed from the side, excluding the perimeter that is adjacent to surface 16. This perimeter bounds the water engaging area A.

These features of the embodiment of FIG. 1—that is, the larger proportion of the total surface area at or near the surface of the surf craft, the greater longitudinal length, and the longer peripheral edge—allows assembly 1 to provide the surfer or other surf craft user greater turning potential, without having to compromise control. In comparison to prior art fin assemblies, assembly 1 allows the surf craft to undertake turns about a smaller arc—or about the same arc, but with less input required from the surfer. In effect, assembly 1 allows the surf craft to be more maneuverable. The extended length of the fin assembly adjacent to the surf craft provides sufficient sectional area to allow the surface to gain sufficient purchase against the water when executing a turn. However, fin assembly 1 also has a depth sufficient to provide for good straight-line stability, without contributing overly to drag due to the relatively small sectional area in the portion of the assembly that is distal from the surf craft.

A summary of the dimensions for assembly 1, four different prior art fins, and two other specific embodiments of the invention are provided in Table 1.

TABLE 1

| Fin Assembly | Depth (mm) | Length (mm) | Peripheral Edge (mm) | Sectional Area ($cm^2$) | 0.3.H Area (%) | Area/PE (mm) |
|---|---|---|---|---|---|---|
| FCS K2.1 (Prior Art) | 115 | 110 | 330 | 99 | 35 | 30.0 |
| Simon Anderson (Prior Art) | 115 | 130 | 345 | 101.5 | 38 | 29.4 |
| FCS G5 (Prior Art) | 115 | 109 | 340 | 95 | 35 | 27.9 |
| FCS G3000 (Prior Art) | 111 | 107 | 320 | 90 | 36 | 28.1 |
| Assembly 1 | 100 | 190 | 430 | 97 | 53 | 22.6 |

TABLE 1-continued

| Fin Assembly | Depth (mm) | Length (mm) | Peripheral Edge (mm) | Sectional Area ($cm^2$) | 0.3.H Area (%) | Area/PE (mm) |
|---|---|---|---|---|---|---|
| Assembly 41 | 113 | 122 | 400 | 93.4 | 41 | 23.4 |
| Assembly 51 | 118 | 146 | 380 | 91.5 | 46 | 24.1 |

A second embodiment of the invention, in the form of a fin assembly 41, is illustrated in FIG. 3, where corresponding features are denoted by corresponding reference numerals. Assembly 41 is not as longitudinally elongate as assembly 1, and intermediate edge 25 is very short. For comparison purposed, some key dimensions of assembly 41 are provided in Table 1.

Relative to assembly 1, assembly 41 has a greater depth, a smaller length adjacent to surface 16, a smaller sectional area A, and a lower percentage of the total area in the 0.3.H zone. The difference in performance between assembly 1 and assembly 41 is that the latter is even more maneuverable than the former, in that is will turn with less force being exerted by the surfer (or turn more when exposed to the same force).

Figure 4:
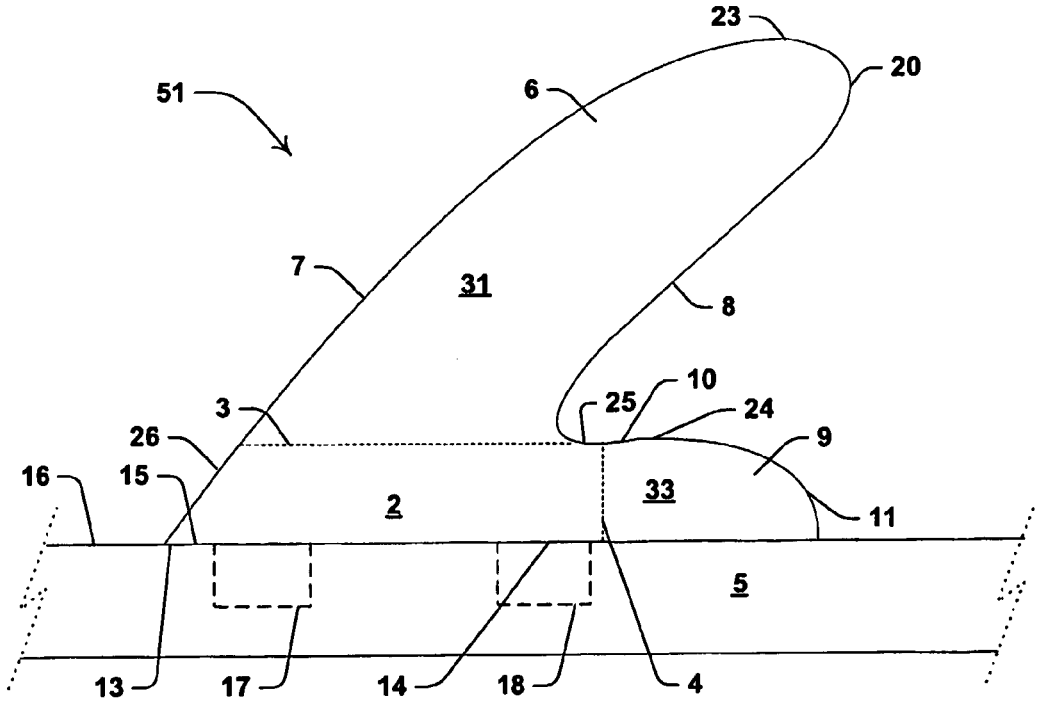
FIG. 4 is a side view of a fin assembly according to a third embodiment of the invention.

A third embodiment of the invention, in the form of a fin assembly 51, is illustrated in FIG. 4, where corresponding features are denoted by corresponding reference numerals. Assembly 51 is not as elongate as assembly 1, but more elongate than assembly 41. The key dimensions of assembly 51 are provided in Table 1 for ease of comparison with the prior art and the other embodiments of the invention.

While the 0.3.H area and the longitudinal length of fin assembly 51 adjacent to surface 16 are greater than for assembly 41, the peripheral edge and the sectional area of assembly 51 are both less than the corresponding dimensions for assembly 41. Moreover, 36% the sectional area of assembly 51 is in the bottom 22% of the height of fin 6. That is, the 0.22.H area is 36%.

The effect of this on the performance of assembly 51 is far smoother in use, in that it offers a more progressive feel to the surfer over assemblies 1 and 41. The trade off is slightly less "initial bite" when entering turns. While such a fin assembly, being more forgiving, is typically best applied to a less experienced surfer, it is also extremely advantageously useable by a more experienced surfer in conditions that dictate gentler inputs.

A significant distinction between assemblies 1 and 41, on the one hand, and assembly 51 on the other, is the form of the secondary fin. In the FIG. 4 embodiment, leading edge 10 of fin 9 is minimal as there is only a slight rise from the low point of edge 25 to point 24. In other embodiments, such as the assembly 61 illustrated in FIG. 5, fin 9 is a lobe 62, in that it does not include a leading edge, but only trailing edge 11. In this embodiment, the portion of edge 11 adjacent to edge 25 is parallel with surface 16. In other embodiments (not shown) a tangent from any point on edge 11 is non-parallel with the plane of surface 16.

All of the fin assemblies of the above embodiments extend normally away from surface 16 and the respective continuous water engaging edges lie within a plane that is also normal to surface 16. In other embodiments, the assembly extends from surface 16 at an angle other than 90°. Additionally, in some embodiments, the water engaging edge is not uni-planar as fins 6 and 9 are disposed in different, but parallel, planes. For example, reference is made to FIG. 6 that illustrates a fin assembly 71 where corresponding features are denoted by corresponding reference numerals. It will be appreciated that fin 6 and fin 9 are transversely spaced apart, although edges 7 and 8 are substantially coplanar, and edges 10 and 11 are substantially coplanar, and those planes are substantially parallel. Base 2 and edge 25 create a smooth transition between the fins and the respective edges.

In the FIGS. 3, 4 and 5 embodiments, fin 9 wholly underlies fin 6, in that fin 6—or lobe 62, as the case may be—extends further rearwardly than fin 9. Additionally, as the continuous water engaging edges for each of the fin assemblies lies within a single plane, edge 10 and 11 underlies both edges 7 and 8.

In a further embodiment of the invention, there is provided a fin assembly 81, as best illustrated in FIG. 7, and where corresponding features are denoted by corresponding reference numerals. It will be noted that fin 6 of assembly 81 extends along plane 19, while fin 9 extends at an angle to that plane. This arrangement provides slightly more drag while board 5 is progressing in a straight line, but allows for an increased initial turn in for the board rider.

Faces 31 and 33 are substantially planar, while faces 32 and 34 are arcuate. Face 31 extends along plane 19.

In use, and as shown in FIG. 8, assembly 81 is mounted to board 5 opposite to a further fin assembly 82 that is a reflection of assembly 81 about plane 19. The inclination of fins 9 from respective planes 19 is such that the plane containing respective pairs of edges 10 and 11 intersect at the tip of the board (not shown). In other embodiments, such as where fin 9 is parallel with fin 6, the assembly as a whole is mounted such the assembly is inclined with respect to the longitudinal axis of board 5.

As also shown in FIG. 8, use is made of a centrally disposed symmetrical fin assembly 83. Typically, assembly 83 is mounted to board 5 rearwardly of assemblies 81 and 82.

The preferred embodiments have been developed to provide surf craft with an increased degree of manoeuvrability. This, in turn, enables the surfer to perform turns on the wave while maintaining proper momentum when progressing down the face of the wave. Turns are achieved by applying weight and/or pressure to the board at various locations so as to cause the edges and surfaces of the board to attack the water surface at different angles and thereby produce turning forces. The fins of the preferred embodiments improve the board's turning ability without unduly affecting forward speed through the water. In some embodiments the forward speed is increased.

The improvement in performance of the fin assemblies of the preferred embodiments is presently understood to arise at least in part from the ability of those embodiments to allow the rake of the primary fin to be increased beyond what would be acceptable for a prior art fin while also providing an increased base length. This, in turn, allows a fin assembly of less height to be used without having to compromise on the straight-line stability of the board.

The last column in Table 1 provides for each of the fin assemblies a quotient having as the numerator the sectional area of the assembly (in $mm^2$) and, as a denominator, the length of the water engaging peripheral edge (in mm). It is apparent that, relative to the prior art, the embodiments of the invention provide low quotients. So, notwithstanding that the embodiments of the invention, in absolute terms, offer a long water engaging peripheral edge, this is done with proportionally less surface area. While conventional wisdom is more concerned with the absolute surface area provided as the critical determinant of performance, the inventors have appreciated that while this is a consideration, it is also important to ensure that the area is distributed advantageously.

Figure 9:
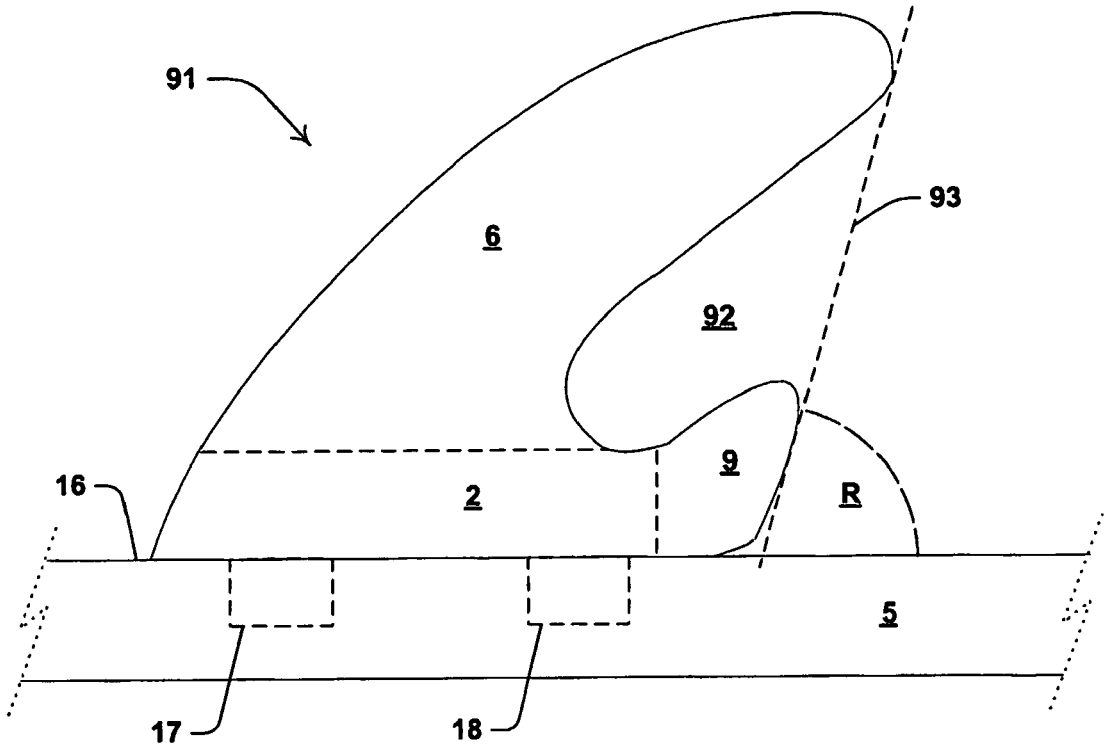
FIG. 9 is a side view of a further fin assembly according to the invention.

A further fin assembly 91, in accordance with another embodiment of the invention, is illustrated in FIG. 9 and has corresponding features denoted by corresponding reference numerals. As with all the other embodiments of the invention illustrated above, assembly 91 includes a feathering or cutaway portion 92 that is bounded by fin 6, fin 9 and base 2. The other boundary for portion 92 is defined by a straight line 93 which extends between the respective rears of fins 6 and 9. In this embodiment, the area of portion 92 is 24% of the total sectional area A of assembly 91. The corresponding characteristics for other fin assemblies are provided in Table 2.

TABLE 2

| Fin Assembly | Feathered Area as a % of assembly area A |
|---|---|
| FCS K2.1 (Prior Art) | 10.6% |
| Simon Anderson (Prior Art) | 15.2% |
| FCS G5 (Prior Art) | 16.2% |
| FCS G3000 (Prior Art) | 17.6% |
| Assembly 41 | 25% |
| Assembly 51 | 36% |

That is, the embodiments of the invention mentioned in Table 2 provide a large degree of feathering, in this case greater than 20%, and more preferably, greater than 24%. Moreover, for those embodiments making use of a lobe or small rear fin, the feathering is typically greater than 30%, and more preferably greater than 35%.

Without wishing to be bound by theory, it is presently understood that at least some of the performance benefits of the preferred embodiments are derived from the increased feathering of the embodiments. In comparison to prior art assemblies, the surface area of the preferred embodiments has been, in effect, "removed" from the fin assembly to create the feathering, and in part "redistributed" to a point closer to board 5.

Line 93 lies at a tangent to the respective rears of fins 6 and 9, and intersects surface 16 at an acute angle R, which is referred to as the rake of fin assembly 91. In the FIG. 9 embodiment, R is about 75°. The corresponding characteristic for assemblies 1, 41 and 51 are 145°, 76° and 86° respectively.

Relatively small amounts of rake have been traditionally used to create drag and holding power through the second half of the turn. The embodiments of the invention, however, use either a high rake or a low rake, although in combination with feathering to achieve the same or a similar affect. In addition, the use of a relatively long length adjacent to surface 16 ensures that the embodiments also provide stability. In this context, the prior art offers rake in the range of about 80° to 90°, while some of the embodiments of the invention have a rake of far greater than 90°, while others have a rake of less than 80°.

The embodiments illustrated in the drawings include a longitudinal extent that is greater than that offered by the prior art due to the rearward extent of the secondary fin or lobe. The inclusion of the secondary fin or lobe allows the depth of the primary fin to be reduced, and the undercut or feathering of the primary fin to be increased, while adding to the stability of the assembly in use. That is, the embodiments of the invention are able to provide both manoeuvrability and stability, two factors that have traditionally had to be traded off against each other when designing a fin assembly.

Board 5 or the other surf craft to which the fin assembly of the invention is mounted typically includes a substantially planar surface 16 in the region of engagement between the assembly and the surface. In other embodiments, surface 15 is other than planar, and surface 15 is complementarily shaped.

As mentioned above, three fin assemblies are mounted to a single board, and this is often done in the known three-fin configuration. This involves having the centre fin assembly disposed along the centre line of the board and adjacent to the rear of the board. The other two fin assemblies are mounted to the board forward of and transversely spaced apart from the centre assembly. Typically, the two assemblies are inclined with respect to the centre line of the board such that the planes passing through the respective assemblies intersect at the leading point of the board. As the fin assemblies of the invention are able to be mounted in existing mounting formations of a board, it will be appreciated that the relatively long longitudinal extent of the assemblies will reduce the longitudinal distance between the trailing edge of the side pair of assemblies and the leading edge of the centre assembly. This will also improve the turning ability of the board. It is preferred, however, that there remains a longitudinal spacing between the leading edge of the centre assembly and the respective trailing edges of the other assemblies. If required, the longitudinally gap is able to match that offered by the prior art through appropriate location of formations 17 and 18 on surface 15. However, preferably, when the invention is applied to a pre-existing board, the longitudinal gap is reduced in comparison to what it would be for a prior art board. By way of example, the longitudinal gap for a prior art board using the Simon Anderson fin assembly is about 75 mm to 90 mm, although this is dependent upon the placement of the specific locating formations on the particular board. The corresponding longitudinal gap for the invention is at least 15 mm less than it is for the Simon Anderson fin. Preferably, however, the gap is at least 25 mm less.

Surprisingly, and unlike prior art fins, the maneuverability of the preferred embodiments are not compromised by the increased base length. This is due to the greater undercut or feathering of the primary fin. That is, the combination of features offered by the preferred embodiments provide improved grip and hold against the water—both at the wave face and at the trough—greater ease of maneuverability and a substantial improvement in speed. In colloquial terms, the fin assembly provides greater drive due to the ability to trap more water.

While not wishing to be bound by theory, it is thought that the improved performance is also due, at least in part, to the emphasised curvature toward the fin tips of the longitudinally viewed fin profiles, as well as the increased sectional area in the portion of the assembly that is adjacent to surface 16.

The assemblies of the preferred embodiments include a sectional area, when viewed from the side, that is substantially equivalent to or less than the corresponding sectional area provided by a prior art Three Fin arrangement. However, the area provided by the embodiments is distributed far differently than that of the prior art, in that the primary fin is undercut to a greater extent, and the secondary fin extends rearwardly.

As the primary fin has a sectional area that is substantially less than a prior art fin, it allows the surfer to perform smaller radius turns. This then allows the surfer to carve the wave face with a greater frequency. However, the directional stability to not degraded due to the presence of the secondary fin.

In those embodiments where the secondary fin is designed to accommodate flex in a direction normal to the plane of the fin, the surfer is able to gain additional acceleration out of turns.

Although it is usual to include a set of three fin assemblies of the invention together on a single surf craft—such as the arrangement illustrated in FIG. 8—in other embodiments, use is made of a single fin assembly that is centrally mounted to the rear of a surfboard.

Where the fin assemblies are applied to surf craft larger than surfboards, the dimensions are scaled accordingly.

The term "fin assembly" is used as a collective label for the various component parts of the preferred embodiments. All those component parts are typically integrally formed in a fixed predetermined relative spatial relationship to define the assembly. In some embodiments, however, some components are designed for relative resilient flexing movement with respect to each other, although still being integrally formed. In still further embodiments, one or more of the component parts are separate but attached to the other parts.

Although the invention has been described with reference to specific examples, it will be appreciated by those skilled in the art that the invention may be embodied in many other forms.

The invention claimed is:

1. A fin assembly for a surf craft, the assembly including:

a base extending in a first direction from a first base portion to a second base portion for mounting the assembly to the surf craft;

a larger fin extending at least partly from the first base portion, the larger fin extending at an acute angle to the first direction and having an acute angle portion such that the larger fin has an acute angle side having a substantial portion of the acute angle side facing in the first direction and a second side opposite the acute angle side;

a smaller fin extending at least partly from the second base portion and positioned on the second base portion relative to the larger fin adjacent the acute angle side and substantially opposite the second side and wherein at least one line normal to the base intersects both the larger and smaller fins; and wherein the larger and smaller fins include respective outer surfaces separate from each other and configured such that when in use attached to a surfcraft the respective outer surfaces of the larger and smaller fins are exposed to water.

2. An assembly according to claim 1 wherein the base and the larger and smaller fins are integrally formed.

3. An assembly according to claim 1 wherein the larger and smaller fins have leading edges and the leading edges of the fins are aligned.

4. An assembly according to claim 1 wherein larger and smaller fins have leading edges and trailing edges and the leading and the trailing edges are aligned.

5. An assembly according to claim 1 wherein the larger fin has primary leading and trailing edges and the smaller fin has secondary leading and trailing edges and the base extends longitudinally between the leading primary edge and the trailing secondary edge.

6. An assembly according to claim 1 wherein the larger fin has primary leading and trailing edges and the smaller fin has secondary leading and trailing edges and the trailing primary edge and the leading secondary edge are joined by an intermediate arcuate edge defined by the base.

7. An assembly according to claim 6 wherein the arcuate edge is of varying radius.

8. An assembly according to claim 1 wherein the larger fin extends along a first plane that is normal to the base.

9. An assembly according to claim 8 wherein both the larger and smaller fins extend along the first plane.

10. An assembly according to claim 1 wherein larger and smaller fins have leading edges and trailing edges and wherein the fins include respective pairs of opposite faces that extend between the leading and trailing edges.

11. An assembly according to claim 10 wherein one or more of the faces are substantially planar.

12. A fin assembly including:

a base for mounting the assembly to an object and extending in a first direction;

a larger fin extending from the base and having a convex primary edge and a concave primary edge; and a smaller fin extending rearwardly from the base and having a leading secondary edge and a trailing secondary edge, wherein the smaller fin is on the concave primary edge side of the larger fin, wherein at least one line normal to the base intersects both the larger and smaller fins and wherein the larger and smaller fins include respective outer surfaces separate from each other and configured such that when in use attached to a surfcraft the respective outer surfaces of the larger and smaller fins are exposed to water.

13. An assembly according to claim 12 wherein the convex primary edge is curved substantially complementarily to the leading secondary edge.

14. A fin assembly including:

a base for mounting the assembly to an object;

a larger fin extending from the base and having a convex primary edge and a concave primary edge and a high rake;

a smaller fin extending rearwardly from the base and having a first secondary edge and a second secondary edge, the smaller fin being adjacent the concave primary edge of the larger fin and providing the assembly with a rake of less than about 90°; and a feathered portion between the larger fin, the smaller fin and the base.

15. An assembly according to claim 14 wherein the edges extend along a single plane.

16. An assembly according to claim 14 wherein the smaller fin is, in use, deformable in a direction normal to a plane including the smaller fin.

17. A fin assembly for a surf craft, the assembly including:

a base for mounting the assembly to the surf craft;

a primary fin that extends from the base and which has a first edge and a second edge that meet at a primary tip, where the edges lie substantially within a common plane; and a secondary fin extending from the base, away from the primary fin, and wherein the secondary fin, having an edge that has a tangent that is parallel to the plane and the primary fin extends such that the secondary fin is positioned between a portion of the primary fin and the base for providing the assembly with a rake of less than about 90°.

18. A fin assembly for a surf craft, the assembly including:

a base having a substantially planar surface for mounting the assembly to the surf craft;

a primary fin that extends from the base at an acute angle and which has a leading edge and a trailing edge that meet at a primary tip wherein the leading edge follows a path in a direction from a leading region to a trailing region of the primary fin; and a secondary fin extending from the base, and positioned relative to the primary fin such that the path followed by the leading edge of the primary fin is partly toward the secondary fin, and wherein the secondary fin, has an edge that has a tangent that is parallel to the surface wherein the primary fin extends relative to the secondary fin such that the assembly has a rake of less than 90°.

19. An assembly according to claim 18 wherein the base, the primary fin and the secondary fin are integrally formed.

20. An assembly according to claim 18 wherein the base and the secondary fin extend longitudinally.

21. An assembly according to claim 20 wherein the base extends longitudinally between the leading edge and the trailing edge.

22. An assembly according to claim 21 wherein the secondary fin is directly underlying the leading and the trailing edge when the base is substantially horizontally oriented.

23. An assembly according to claim 22 wherein the secondary fin, the trailing edge and the leading edge extend in a common plane.

24. An assembly according to claim 18 wherein the trailing edge is feathered in an area intermediate of the secondary fin and the leading edge.

25. An assembly according to claim 24 wherein the trailing edge and the secondary fin are joined by an intermediate arcuate edge defined by the base.

26. An assembly according to claim 25 wherein the arcuate edge is of varying radius.

27. An assembly according to claim 18 wherein the primary fin extends along a first plane that is normal to the base.

28. An assembly according to claim 18 wherein the primary fin includes a pair of opposite faces that extend between the leading and the trailing edges.

29. An assembly according to claim 28 wherein one or both of the faces are substantially planar.

30. An assembly according to claim 28 wherein one or both of the faces are substantially arcuate.

31. An assembly according to claim 18 wherein the fin assembly includes one or more mounting formations that extend from the surface for engaging with complementary locating formations extending from the surf craft.

32. An assembly according to claim 31 wherein the or each mounting formation is a protrusion, and the or each locating formation is a recess.

33. An assembly according to claim 32 wherein the assembly includes two spaced apart mounting formations and the surf craft includes at least two locating formations.

34. A fin assembly including:

a base for mounting the assembly to an object;

a large fin extending from the base in a direction at an acute angle relative to the base;

a smaller fin extending from the base in the acute angle defined by the large fin and the base, the smaller fin trailing the large fin and the large fin extending relative to the smaller fin such that the assembly has a rake of less than 90°, wherein the base, the large fin and the smaller fin include a combined total sectional area ($A_f$); and a feathered portion between two or more of the large fin, the smaller fin and the base, wherein the feathered portion includes a sectional area ($A_p$) and $A_p > 0.2.A_f$.

35. A surf craft including a fin assembly of any one of claim 1, claim 12, claim 14, claim 17, claim 18 or claim 34.

36. A surf craft including a fin assembly of any one of claim 12, claim 14 or claim 34, where the object is a surf craft and the assembly is mounted to the surf craft.

37. A method of manufacturing a fin assembly for a surf craft, the method including:

forming a base for mounting the assembly to the surf craft;

forming a larger fin that extends from the base at an acute angle relative to the base and which has a leading primary edge and a trailing primary edge; and forming a smaller fin that extends from the base such that the smaller fin is in the acute angle of between the larger fin and the base and which has a leading secondary edge and a trailing secondary edge, such that the larger fin extends relative to the smaller fin such that the assembly has a rake of less than 90°.

38. A method according to claim 37 wherein the forming steps are performed simultaneously.

39. A method according to claim 37 wherein the base, the larger fin and the smaller fin are integrally formed.

40. A method according to claim 37 including the additional step of forming at least one mounting formation that extends from the base for engaging with a complementary locating formation that extends from the surf craft.

41. A fin assembly for a surf craft, the assembly, in use, providing a predetermined sectional water engaging area (A) and including:

a base for mounting the assembly to extend from a surface of the surf craft;

a larger fin extending from the base at an acute angle relative to the base; and a smaller fin extending from the base in the acute angle between the larger fin and the base, the smaller fin trailing the larger fin and the larger fin extending rearwardly of the smaller fin for providing the assembly with a rake of less than 90°, wherein a high proportion of A is near the surface.

42. An assembly according to claim 41 wherein the larger fin terminates in a point having a predetermined height (H) with respect to the surface, and at least 0.4.A is within 0.3.H of the surface.

43. An assembly according to claim 41 wherein the larger fin terminates in a point having a predetermined height (H) with respect to the surface and wherein at least 0.45.A is within 0.3.H of the surface.

44. An assembly according to claim 41 wherein the larger fin terminates in a point having a predetermined height (H) with respect to the surface and wherein at least 0.5.A is within 0.3.H of the surface.

45. An assembly according to claim 41 wherein at least 0.35.A is within 0.22H of the surface.

46. A unitary fin structure suitable for use with a surfboard, the unitary fin structure comprising a fin body having a base edge which when the fin structure is installed cooperates with an underside structure of the surfboard, the fin body including a front edge and a rear edge, a feathered or cutout portion in the rear edge extending towards the front edge, the feathered or cutout portion separating part of the fin body into two limbs, one limb being between the base edge and the feathered or cutout portion so as to form a stabilizing fin section of the fin body and the other limb forming a maneuvering fin section of the fin body wherein a tip of the maneuvering fin extends over at least a portion of the stabilizing fin, and wherein the maneuvering fin is one piece with the stabilizing fin wherein at least one line normal to the base intersects both the maneuvering and stabilizing fins.

47. A unitary fin structure in accordance with claim 46 wherein the base edge abuts an underside face of the surfboard.

48. A unitary fin structure in accordance with claim 47 wherein, when installed, an angle between a rearwardly-disposed section of the underside face of the surfboard and a construction line extending between a rearmost point of the stabilizing fin section and the rearmost point of the maneuvering fin section is less than 90°.

49. A unitary fin structure in accordance with claim 47 wherein when installed, a fin perimeter extends from the underside of the surfboard, the fin perimeter comprising the front edge and the rear edge, wherein the front edge extends from a front corner of the base edge rearwardly and away from the underside face of the surfboard to a rounded distal tip of the maneuvering section in a compound arcuate manner, and the rear edge extends from the rounded distal tip to a rear corner of the base edge, the rear edge having a first intermediate portion being coincident with an inner concave periphery of the feathered portion and having a second intermediate portion being coincident with a rounded tip of the stabilizing fin portion.

50. A unitary fin structure in accordance with claim 46 wherein the feathered or cutout portion is substantially concave.

51. A unitary fin structure in accordance with claim 46 wherein the fin body includes a selected sectional water engaging area (A), the maneuvering fin section terminates at a point disposed at a selected height (H) from the base edge, and at least 0.4 A is within 0.3 H of the base edge.

52. A unitary fin structure in accordance with claim 46 wherein the fin body includes a combined total sectional area ($A_f$) and the feathered portion includes a sectional area ($A_t$), and $A_t$ is greater than 0.2 $A_f$.

53. A unitary fin structure in accordance with claim 46 wherein when installed, a remote tip of the maneuvering fin section of the main body is disposed rearward of a rearwardmost tip of the stabilizing fin section of the fin body.

54. A unitary fin structure in accordance with claim 46 wherein one or more mounting formations extend from the base edge for engaging with complimentary locating formations associated with the surfboard.

55. A unitary fin structure in accordance with claim 54 wherein the or each mounting formation is a protrusion, and the or each locating formation is a recess.

56. A unitary fin structure in accordance with claim 46 wherein two spaced apart mounting formations are provided, to correspond with two locating formations disposed on the surfboard.

57. A unitary fin structure in accordance with claim 46 wherein the fin body includes a sectional area of less than 95 $cm^2$.

58. A unitary fin structure in accordance with claim 57 wherein the sectional area is between about 90 $cm^2$ and 95 $cm^2$.

59. A unitary fin structure in accordance with claim 58 wherein a perimeter of the sectional area excluding the base edge is greater than about 380 mm.

60. A unitary fin structure in accordance with claim 46 wherein the fin body includes a pair of opposite faces which extend between the front and rear edges, and one or both of the faces are substantially planar.

61. A unitary fin structure in accordance with claim 46 wherein the fin body includes a pair of opposite faces which extend between the front and rear edges, and one or both of the faces are substantially arcuate.

62. A unitary fin structure in accordance with claim 46 wherein when installed the maneuvering fin section is disposed generally coplanar with a normal plane which extends substantially perpendicularly to the underside of the board, while the stabilizing fin section extends at an angle to the normal plane.

63. A unitary fin structure in accordance with claim 46 wherein the fin body has a streamline profile in transverse section which extends substantially from the front edge of the fin body to the rear edge thereof, the streamline section profile extending over at least a portion of the stabilizing fin section.

64. A unitary fin structure in accordance with claim 46 wherein the stabilizing fin section is a lobe.

65. A unitary fin structure in accordance with claim 46 wherein when installed, a remote tip of the stabilizing fin section of the main body is disposed rearward of a rearward-most tip of the base edge.

* * * * *